US009163363B2

(12) United States Patent
Karau

(10) Patent No.: US 9,163,363 B2
(45) Date of Patent: Oct. 20, 2015

(54) LOAD-BEARING PAVER AND METHOD OF INSTALLATION

(71) Applicant: Pavestone, LLC, Atlanta, GA (US)

(72) Inventor: William H. Karau, Southlake, TX (US)

(73) Assignee: PAVESTONE, LLC, Atlanta, GA (US)

( * ) Notice: Subject to any disclaimer, the term of this patent is extended or adjusted under 35 U.S.C. 154(b) by 0 days.

(21) Appl. No.: 14/263,985

(22) Filed: Apr. 28, 2014

(65) Prior Publication Data

US 2014/0255094 A1 Sep. 11, 2014

Related U.S. Application Data

(63) Continuation of application No. 13/791,512, filed on Mar. 8, 2013, now abandoned.

(51) Int. Cl.

| | |
|---|---|
| ***E01C 5/00*** | (2006.01) |
| ***E01C 5/06*** | (2006.01) |
| ***E01C 9/00*** | (2006.01) |
| ***E01C 11/22*** | (2006.01) |

(52) U.S. Cl.

CPC ... *E01C 5/00* (2013.01); *E01C 5/06* (2013.01); *E01C 9/004* (2013.01); *E01C 11/222* (2013.01); *E01C 2201/12* (2013.01)

(58) Field of Classification Search

USPC ..... 404/34, 41, 37–39; D25/113

See application file for complete search history.

(56) References Cited

U.S. PATENT DOCUMENTS

| | | | | |
|---|---|---|---|---|
| 149,658 | A | 4/1874 | Ingalls | |
| 191,273 | A | 5/1877 | Waters | |
| 195,286 | A | 9/1877 | Ingalls | |
| 310,662 | A | 1/1885 | Freeman | |
| 345,726 | A | 7/1886 | Promoli | |
| 468,840 | A * | 2/1892 | Steiger | 404/41 |
| 584,269 | A | 6/1897 | Northcutt | |
| 1,032,858 | A | 7/1912 | Pettit | |
| 1,439,446 | A * | 12/1922 | Regan | 52/603 |
| 1,984,393 | A * | 12/1934 | Brown | 52/284 |
| 2,029,814 | A * | 2/1936 | Dunn | 404/38 |
| 2,060,746 | A * | 11/1936 | Porter | 404/38 |
| 2,095,012 | A * | 10/1937 | Renkert | 404/38 |
| 4,429,506 | A | 2/1984 | Henderson | |
| 4,840,825 | A | 6/1989 | Aristodimou | |
| 6,260,326 | B1 | 7/2001 | Muller-Hartburg | |
| 6,263,633 | B1 * | 7/2001 | Hagenah | 52/596 |
| 6,863,469 | B2 | 3/2005 | Bolduc et al. | |
| 6,988,847 | B2 * | 1/2006 | Lazar | 404/39 |
| 7,197,855 | B2 | 4/2007 | Della Pepa | |
| 7,220,078 | B2 | 5/2007 | Drost et al. | |
| 7,367,167 | B2 | 5/2008 | Takayanagi | |
| D585,566 | S * | 1/2009 | Stenekes | D25/113 |
| 7,930,865 | B2 | 4/2011 | Barlow | |
| 7,984,600 | B2 | 7/2011 | Alford et al. | |
| D688,811 | S * | 8/2013 | Ciccarello | D25/113 |
| 8,757,922 | B1 * | 6/2014 | Ciccarello | 404/38 |
| 2006/0230701 | A1 | 10/2006 | Pepa | |
| 2012/0020730 | A1 * | 1/2012 | Chow | 404/34 |

* cited by examiner

*Primary Examiner* — Thomas B Will
*Assistant Examiner* — Katherine Chu
(74) *Attorney, Agent, or Firm* — Jackson Walker L.L.P.; Christopher J. Rourk

(57) ABSTRACT

A paver comprising a first side having a length L1 and a groove disposed along the length L1 of the first side. A second side having a length L2 and a tongue disposed along the length L2 of the second side. A third side opposite the first side and having a tongue with length L3 disposed along the first side, where the length L3 is less than the length L1. A fourth side having a substantially flat surface with a length L4, where the length L4 is equal to L1 minus L3.

20 Claims, 22 Drawing Sheets

LOAD-BEARING PAVER AND METHOD OF INSTALLATION

CROSS-REFERENCE TO RELATED APPLICATION

The present application is a continuation application of U.S. Ser. No. 13/791,512, filed Mar. 8, 2013, which is hereby incorporated by reference for all purposes.

TECHNICAL FIELD

The present disclosure relates to pavers, and more specifically to a load bearing paver and method of installation that improves drainage while maintaining load-bearing capacity.

BACKGROUND OF THE INVENTION

Pavers are used to provide a stable surface without the need for pouring concrete, asphalt or other materials. While pavers are easier to install than such other materials, they suffer from a number of drawbacks, such as instability under load.

SUMMARY OF THE INVENTION

In accordance with an exemplary embodiment of the present disclosure, a paver is provided that includes a first side having a length L1 and a groove disposed along the length L1 of the first side, such as a groove that is located midway between the top surface and the bottom surface of the paver. The paver has a second side having a length L2 and a tongue disposed along the length L2 of the second side, so that the tongue of the second side of the paver can be placed into the groove of another paver. The paver has a third side opposite the first side and having a tongue with length L3 disposed along the first side, where the length L3 is less than the length L1, thus forming a flat surface area on the third side where the tongue does not extend to, and also allowing the tongue of the third side of the paver to be placed into the groove of another paver and adjacent to a tongue from the second side of a third paver. A fourth side has a substantially flat surface with a length L4, where the length L4 is equal to L1 minus L3, or the flat surface area of the third side, so that the fourth side of the paver can be placed adjacent to the third side of another paver. In this manner, the pavers can be interlocked to provide additional stability.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
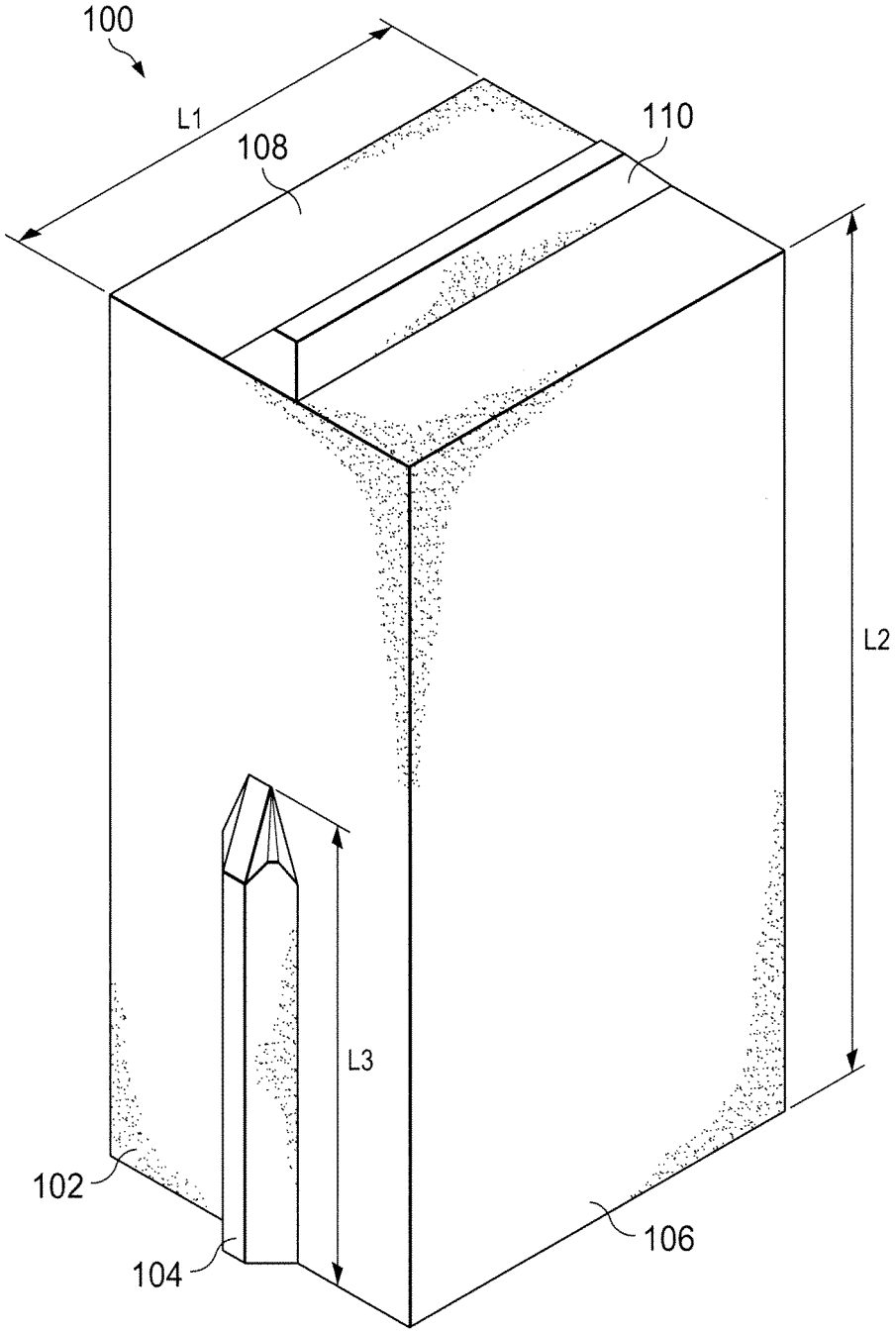
FIG. 1 is a diagram of a paver in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of paver 100 in accordance with an exemplary embodiment of the present disclosure. Paver 100 can be formed from concrete, masonry or other suitable materials. Paver 100 can be wet cast, dry cast or formed in other suitable manners.

Paver 100 includes tongue 104, which has a length L3, and tongue 110, which has a length L1. Tongue 104 is disposed on side 102, which has a length L2 which is equal to two times L3. Tongue 110 is disposed on side 108, which has a length L1. Side 106 can be placed upwards or downwards in use, to form the paver surface or paver base, respectively. Paver 100 can be formed in a mold by a wet cast process, a dry cast process, or in other suitable manners, and is configured so that the mold can be lifted off of paver 100 after it has stabilized. In one exemplary embodiment, side 108 can be the cull of paver 100, side 106 can be one of the beds of paver 100 and side 102 can be the side of paver 100.

Figure 2:
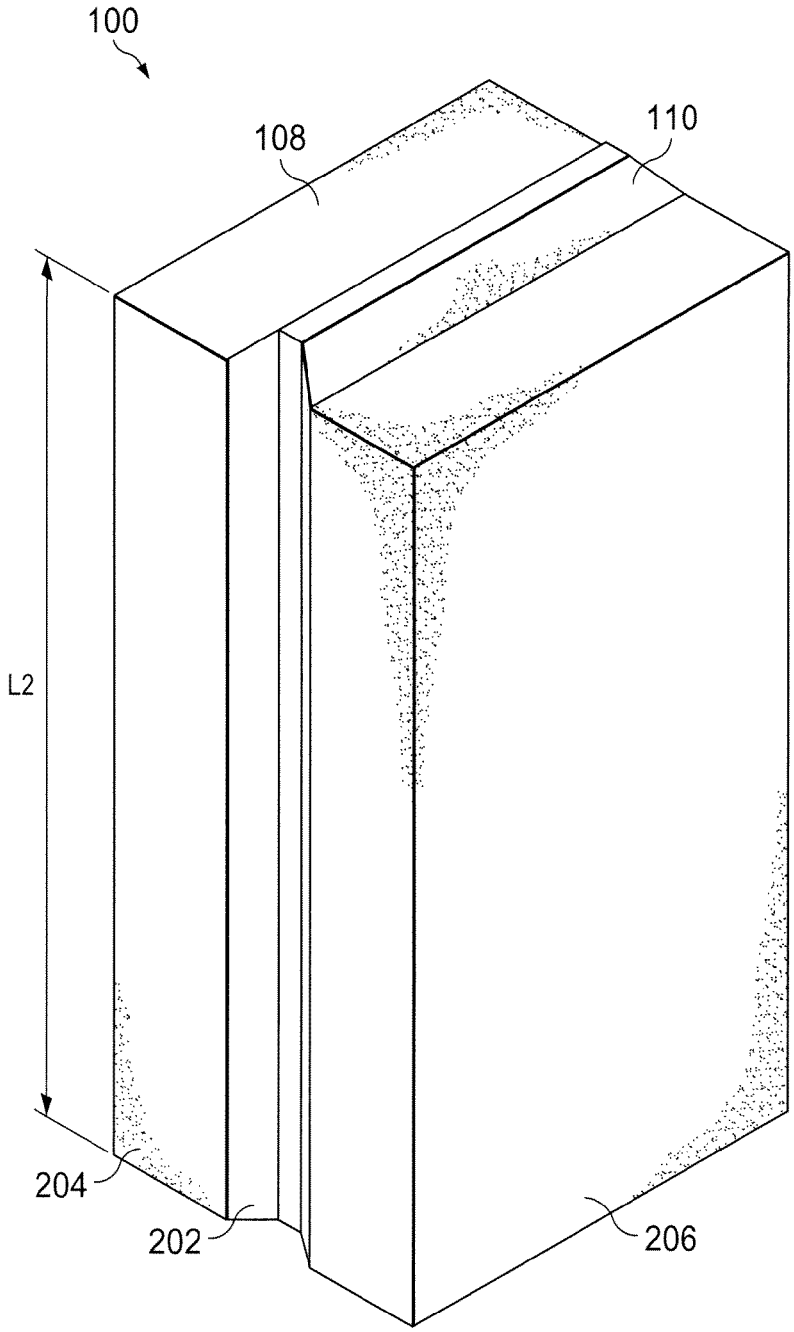
FIG. 2 is a diagram of a paver showing a groove disposed in a side.

FIG. 2 is a diagram of paver 100 showing groove 202 disposed in side 204. Groove 202 has a length L2, such that tongues 104 and 110 can be inserted into groove 202 when paver 100 is installed. Side 206 is opposite to side 106, and can be placed upwards or downwards in use, to form the paver surface or paver base, respectively.

Figure 3:
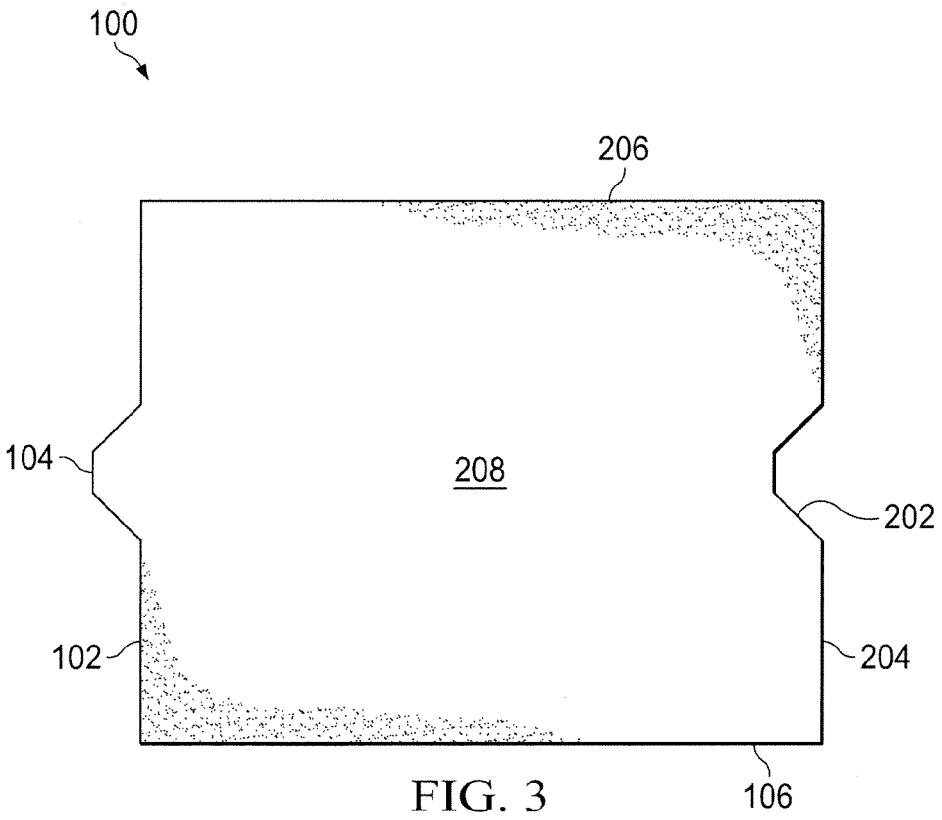
FIG. 3 is a bottom view of a paver showing a tongue disposed on a side, a groove disposed in another side, additional sides and a bottom surface.

FIG. 3 is a bottom view of paver 100 showing tongue 104 disposed on side 102, groove 202 disposed in side 204, sides 106 and 206, and bottom surface 208. Bottom surface 208 is flat, and forms the base of paver 100 during dry casting, or the top surface during wet casting. In one exemplary embodiment, side 208 can be the end of paver 100, sides 106 and 206 can be the beds of paver 100, side 102 can be the side of paver 100 and side 204 can be the face of paver 100.

Figure 4:
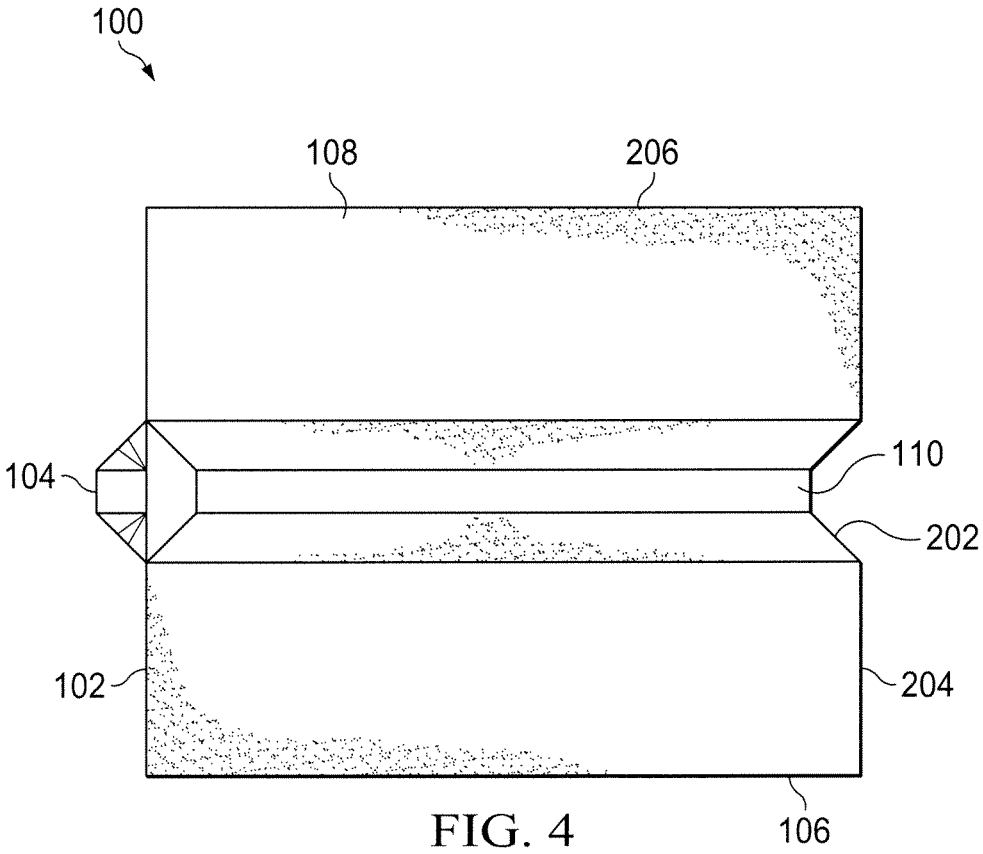
FIG. 4 is a top view of a paver showing a tongue disposed on first side, a groove disposed in a second side, a tongue disposed on a third side, and opposing sides which can be can be placed upwards or downwards in use, to form the paver surface or paver base, respectively.

FIG. 4 is a top view of paver 100 showing tongue 110 disposed on side 108, groove 202 disposed in side 204, tongue 104 disposed on side 102, and opposing sides 106 and 206, either of which can be can be placed upwards or downwards in use, to form the paver surface or paver base, respectively.

Figure 5:
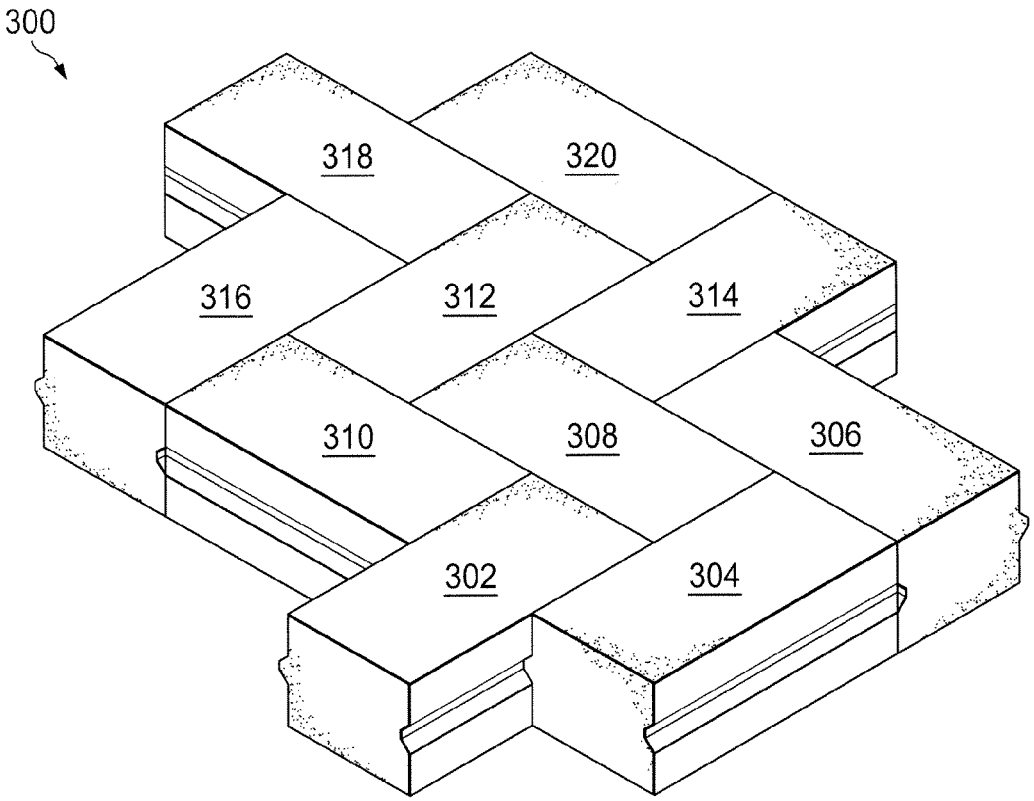
FIG. 5 is a diagram of pavers as installed, in accordance with an exemplary embodiment of the present disclosure.

FIG. 5 is a diagram of pavers 302 through 320 as installed, in accordance with an exemplary embodiment of the present disclosure. A first paver 302 is placed on a surface with side 206 facing downwards. A second paver 304 is then placed adjacent to paver 302, with tongue 104 of paver 304 disposed in groove 202 of paver 302. A third paver 308 is then placed adjacent to pavers 302 and 304, with the bottom surface 208 of paver 308 placed adjacent to the section of side 102 of paver 304 that does not include tongue 104. In addition, tongue 110 of paver 302 is inserted into groove 202 of paver 308. A fourth paver 306 is then placed adjacent to pavers 304 and 308, such that tongue 110 of paver 304 is placed in groove 202 of paver 306, and tongue 104 of paver 308 is also placed in groove 202 of paver 306. The remaining pavers 310 through 320 are placed in a similar manner, so as to form an interlocking herringbone pattern, so as to provide an interlocking paver system with improved resistance to movement that can be caused by forces applied to each of pavers 302 through 320, such as from an automobile tire, pedestrians, horses or other sources of surface wear and tear. Without interlocking tongues and grooves as described, the pavers would be susceptible to being dislodged, which can lead to failure of the paver system, damage to vehicles, injuries to persons or animals, or other undesirable conditions. The interlocking system of tongues and grooves provides stability and durability to the paver system of FIG. 5.

Figure 6:
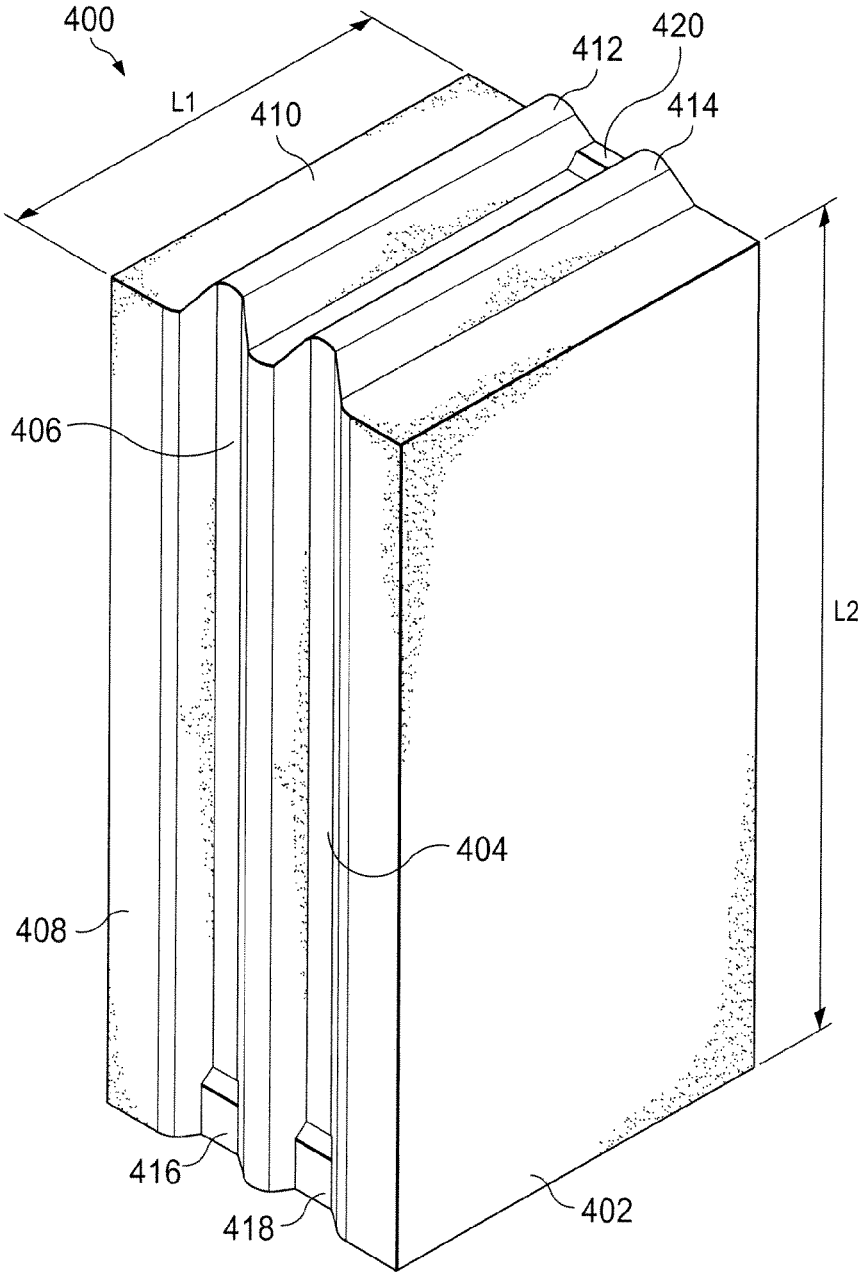
FIG. 6 is a diagram of a paver in accordance with an exemplary embodiment of the present disclosure.

FIG. 6 is a diagram of paver 400 in accordance with an exemplary embodiment of the present disclosure. Paver 400 can be formed from concrete, masonry or other suitable materials. Paver 400 can be wet cast, dry cast or formed in other suitable manners.

Paver 400 includes grooves 404 and 406 disposed in side 408, and tongues 412 and 414 disposed on side 410. Side 402 can be placed upwards or downwards in use, to form the paver surface or paver base, respectively. Tongues 412 and 414 each have a length L1, and grooves 404 and 406 each have a length L2.

In addition, grooves 404 and 406 include spacers 418 and 416, respectively, which are used to create a space between adjacent pavers so as to allow the joints to be filled with sand during installation. Each spacer 418 and 416 extends for a predetermined length of the groove and fills a portion of the groove, such as one half of the depth of the groove, one third of the depth of the groove, or other suitable portions. Likewise, notch 420 is disposed on side 410 in the channel between tongues 412 and 414 to create a space between adjacent pavers. Spacer 420 extends for a predetermined length of the tongues and fills a portion of the channel between the tongues, such as one half of the depth of the channel, one third of the depth of the channel, or other suitable portions.

Figure 7:
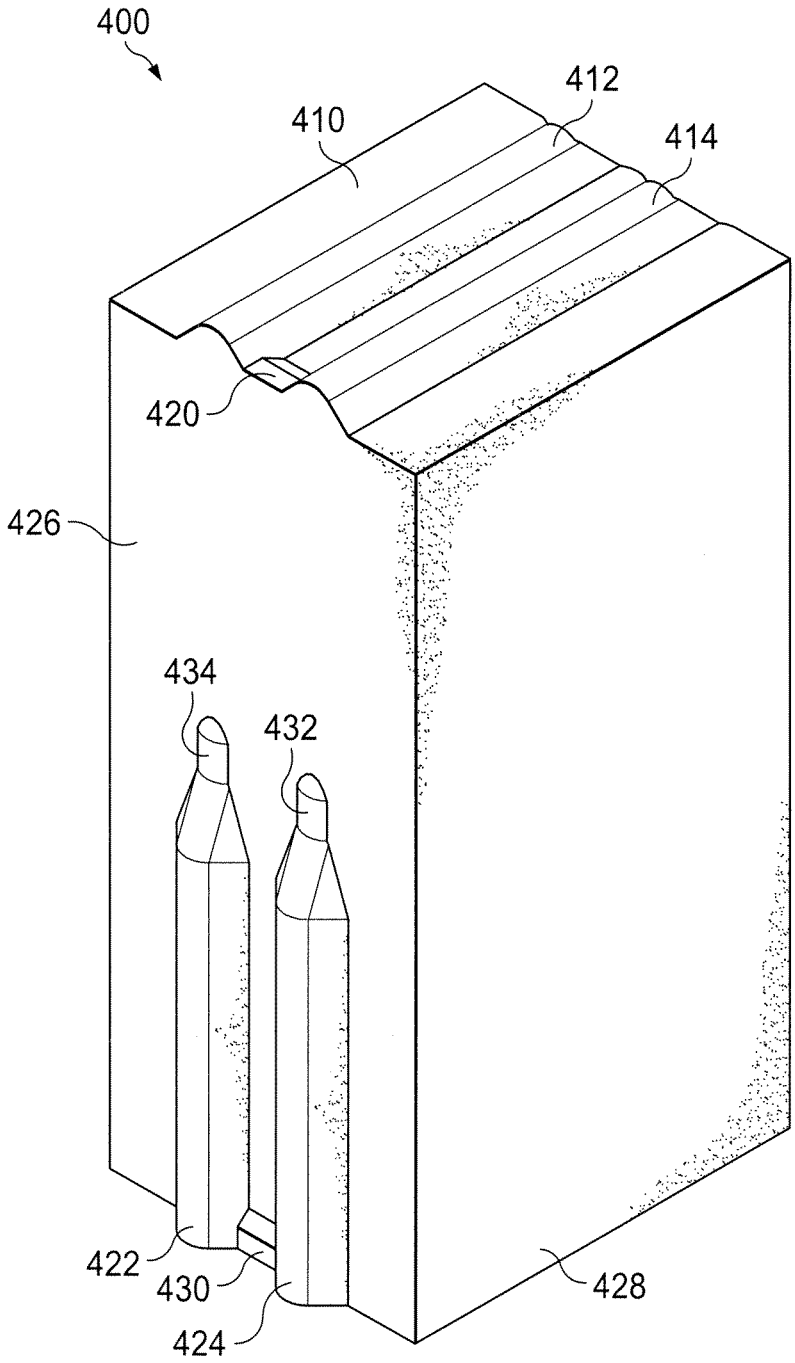
FIG. 7 is a diagram of a paver showing tongues disposed on a side.

FIG. 7 is a diagram of paver 400 showing tongues 422 and 424 disposed on side 426. Side 428 is opposite side 402, and can be placed upwards or downwards in use, to form the paver surface or paver base, respectively. In addition, spacer 430 is disposed on side 426 in the channel between tongues 422 and 424, to create a space between adjacent pavers so as to the joints between pavers 400 to be filled with sand during installation. In addition, spacers 432 and 434 are provided to further allow the joints between pavers 400 to be filled with sand during installation.

Figure 8:
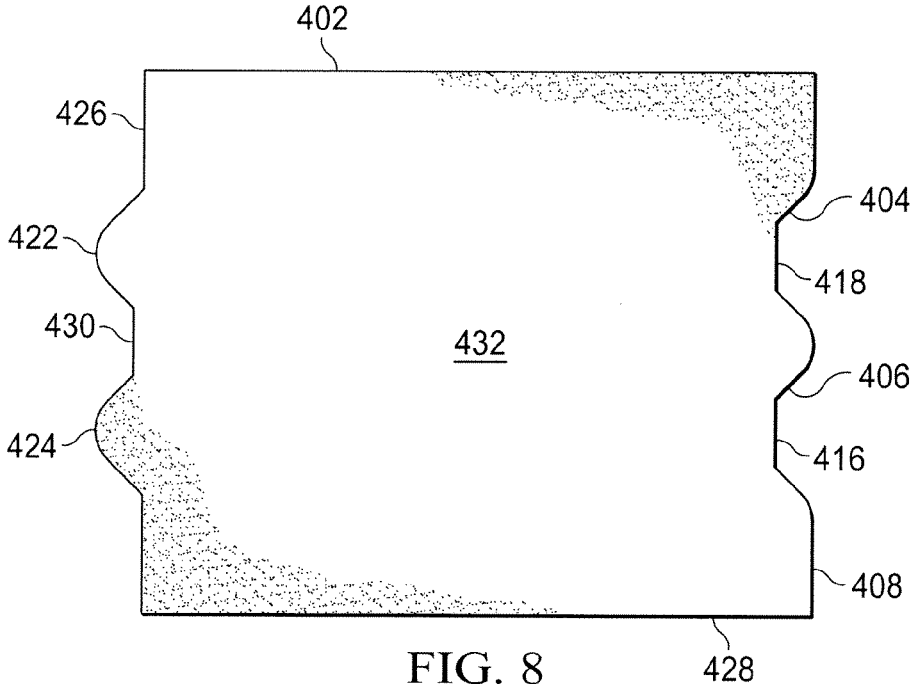
FIG. 8 is a bottom view of a paver showing a bottom surface 432.

FIG. 8 is a bottom view of paver 400 showing bottom surface 432. In addition, tongues 422 and 424 and spacer 430 disposed on side 426 are shown, and grooves 404 and 406 and spacers 418 and 416 disposed in side 408 are shown, and opposing sides 402 and 428 are also shown. Bottom surface 432 is flat, and forms the base of paver 400 during casting.

Figure 9:
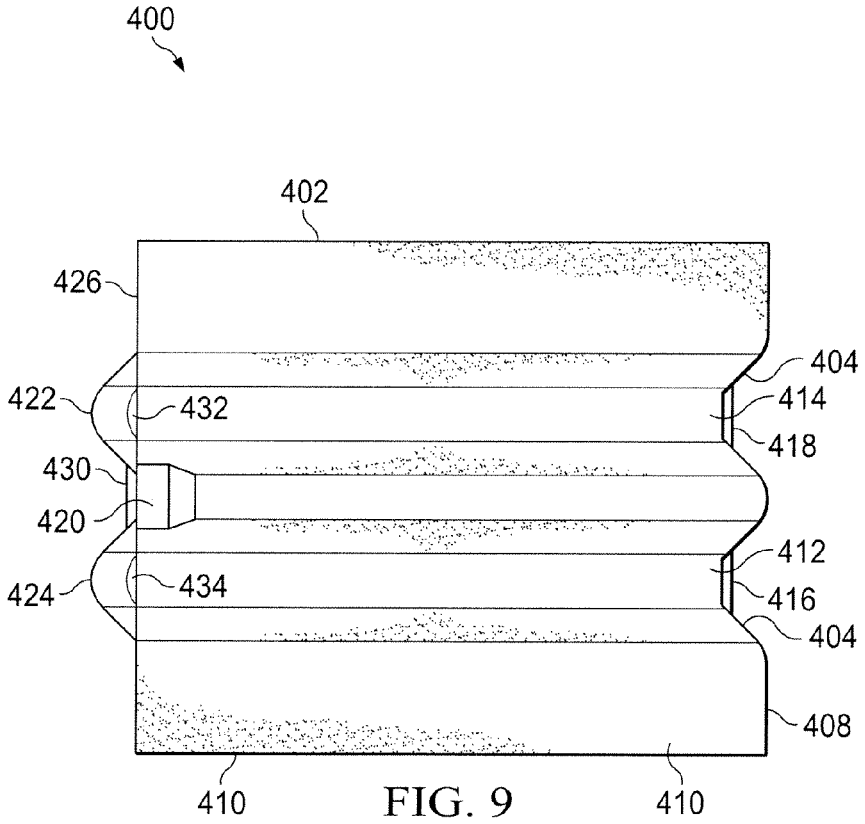
FIG. 9 is an overhead view of a paver showing a side with tongues.

FIG. 9 is an overhead view of paver 400 showing side 410 with tongues 412 and 414. In addition, tongues 422 and 424 and spacers 430, 432 and 434 disposed on side 426 are shown, and grooves 404 and 406 and spacers 418 and 416 disposed in side 408 are shown, and opposing sides 402 and 428 are also shown.

Figure 10:
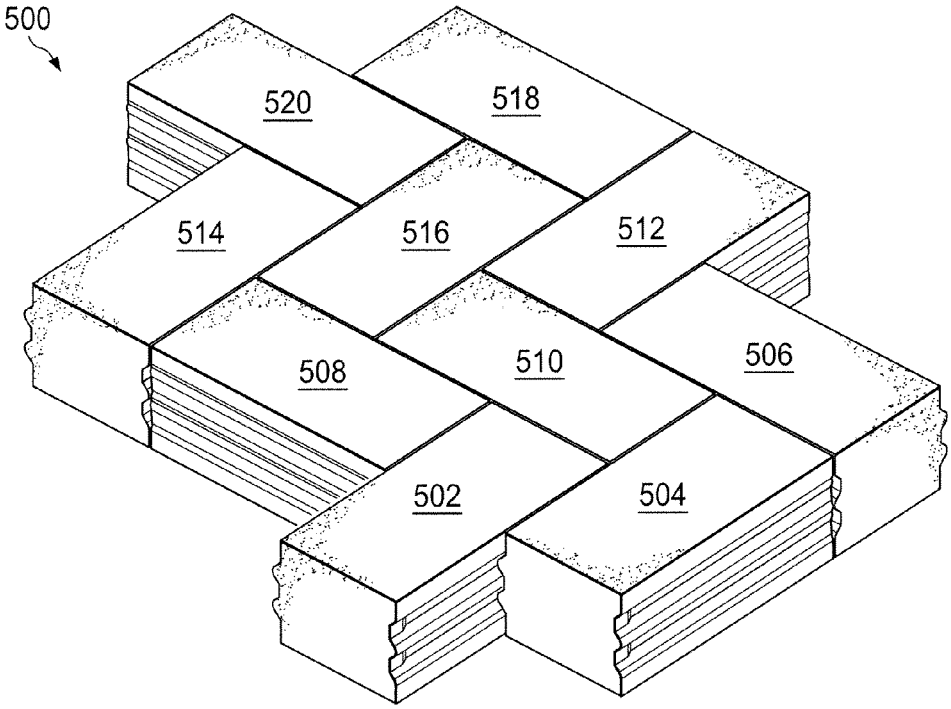
FIG. 10 is a diagram of pavers as installed, in accordance with an exemplary embodiment of the present disclosure.

FIG. 10 is a diagram of pavers 502 through 520 as installed, in accordance with an exemplary embodiment of the present disclosure. A first paver 502 is placed on a surface with side 402 facing downwards. A second paver 504 is then placed adjacent to paver 502, with tongues 422 and 424 of paver 504 disposed in grooves 404 and 406 of paver 502. A third paver 510 is then placed adjacent to pavers 502 and 504, with the bottom surface 432 of paver 510 placed adjacent to the section of side 426 of paver 504 that does not include tongues 422 and 424. In addition, tongues 412 and 414 of paver 502 are inserted into grooves 404 and 406 of paver 510. A fourth paver 506 is then placed adjacent to pavers 504 and 510, such that tongues 412 and 414 of paver 504 are placed in grooves 404 and 406 of paver 506, and tongues 422 and 424 of paver 510 are also placed in grooves 404 and 406 of paver 506. The remaining pavers 508 through 520 are placed in a similar manner, so as to form an interlocking herringbone pattern, so as to provide an interlocking paver system with improved resistance to movement that can be caused by forces applied to each of pavers 502 through 520, such as from an automobile tire, pedestrians, horses or other sources of surface wear and tear. In addition, spaces are formed between the blocks by spacers 416, 418, 420 and 430 of each paver, so as to allow the joints between adjacent pavers to be filled with sand.

Figure 11:
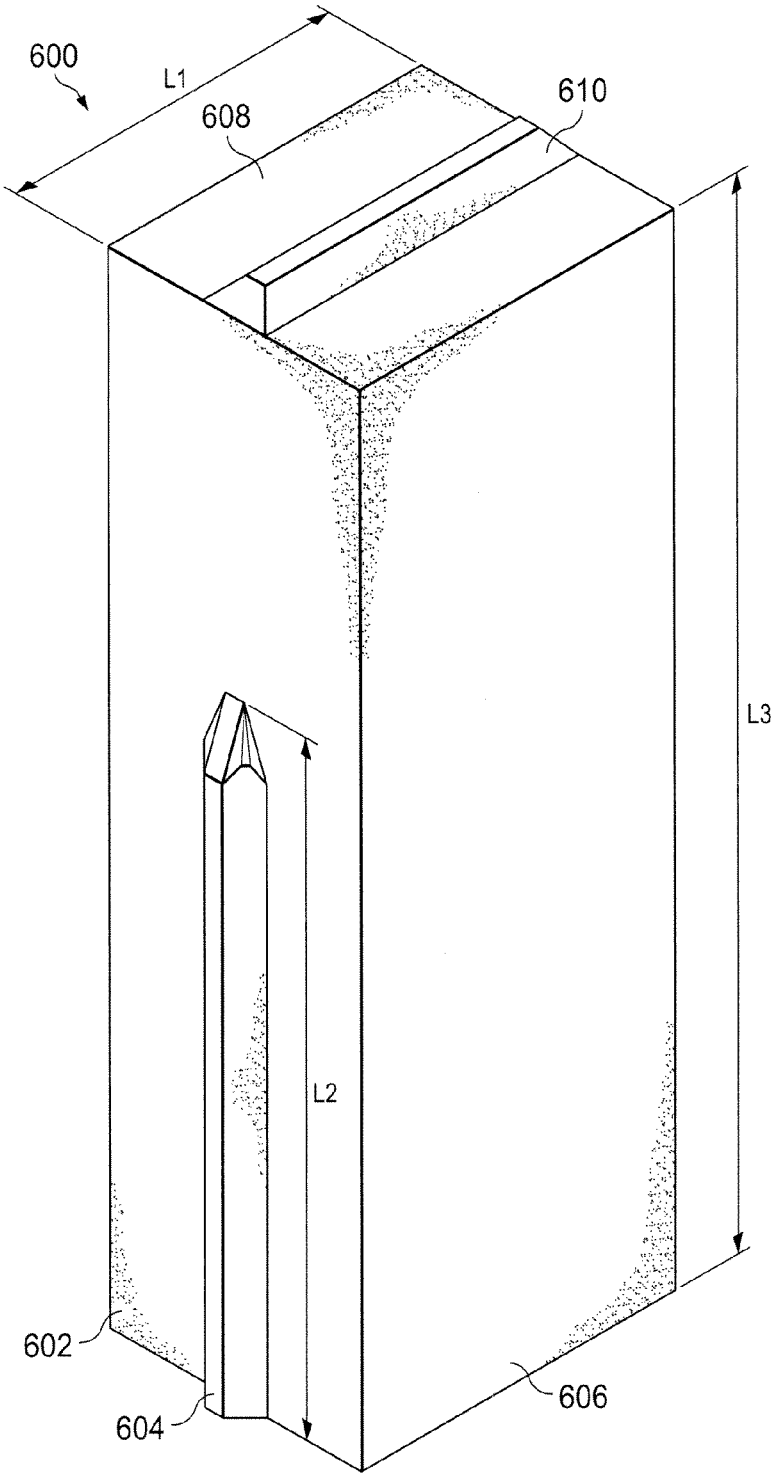
FIG. 11 is a diagram of a paver in accordance with an exemplary embodiment of the present disclosure.

FIG. 11 is a diagram of a paver 600 in accordance with an exemplary embodiment of the present disclosure. Paver 600 can be formed from concrete, masonry or other suitable materials. Paver 600 can be wet cast, dry cast or formed in other suitable manners. Side 606 can be placed upwards or downwards in use, to form the paver surface or paver base, respectively.

Paver 600 includes tongue 610 disposed on side 608 and having a length L1, and tongue 604 disposed on side 602 and having a length L2. The length of side 602 is L3, where L3 equals L1 plus L2. Paver 600 is similar to paver 100, except that instead of sides having a 1:2 ratio as is shown for paver 100, paver 600 has sides that have an L3:L1 ratio, where L1, L2 and L3 can have selected values to provide predetermined block sides dimension for paver 600, such as 3:1, 4:1, 3:2 or other suitable ratios.

Figure 12:
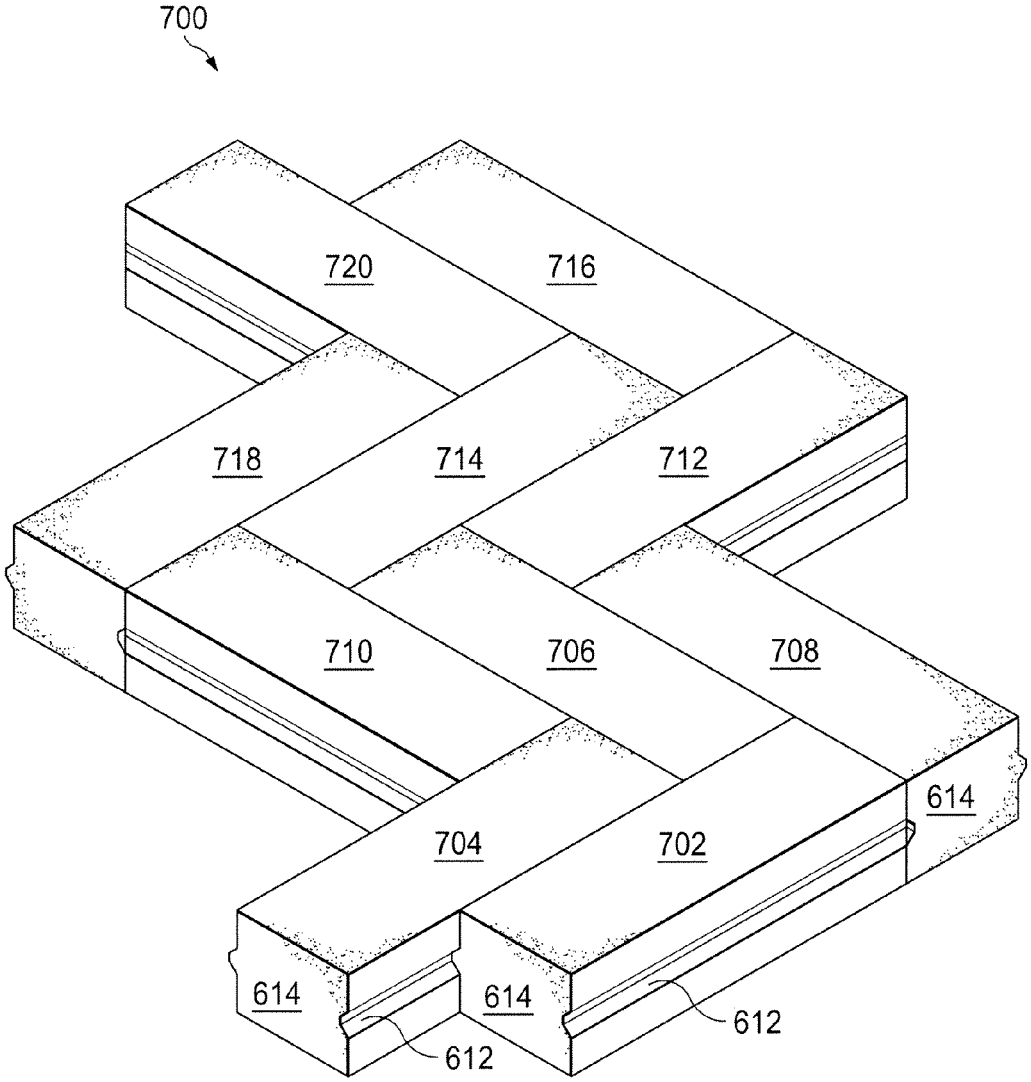
FIG. 12 is a diagram of pavers installed in a herringbone configuration.

FIG. 12 is a diagram of pavers 702 through 720 installed in a herringbone configuration. A first paver 702 is disposed adjacent to a second paver 704, with tongue 604 of paver 702 inserted into groove 612 of paver 704. A third paver 706 is then disposed adjacent to pavers 702 and 704, with base 614 of paver 706 adjacent to the portion of side 602 of paver 702 that is flat (i.e. that does not include tongue 604). Likewise, tongue 610 of paver 704 is inserted into groove 612 of paver 706. Likewise, pavers 708 through 720 are disposed in a similar interlocking manner, so as to form a herringbone pattern of pavers that provide an interlocking paver system with improved resistance to movement that can be caused by forces applied to each of pavers 702 through 720, such as from an automobile tire, pedestrians, horses or other sources of surface wear and tear.

Figure 13:
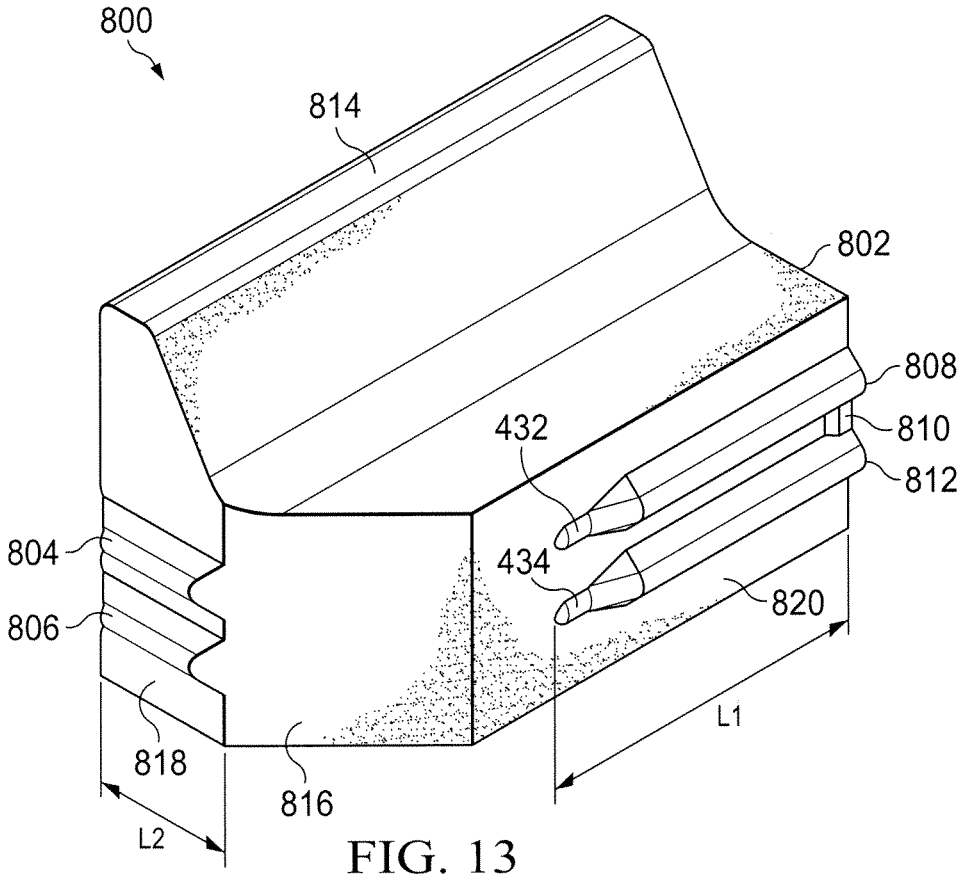
FIG. 13 is a diagram of a paver for providing an additional space for supporting vegetation in accordance with an exemplary embodiment of the present disclosure.

FIG. 13 is a diagram of a paver 800 for providing an additional space for supporting vegetation in accordance with an exemplary embodiment of the present disclosure. Paver 800 can be formed from concrete, masonry or other suitable materials. Paver 800 can be wet cast, dry cast or formed in other suitable manners.

Paver 800 includes tongues 804 and 806 disposed on side 818 and having length L2, and tongues 808 and 812 disposed on side 820 and having length L1. In addition, angled side 816 is provided to create an additional drainage space and vegetative or soil fill space when paver 800 is installed. In addition, paver 800 includes fin 814, which provides structural support for vehicular or other traffic, in addition to vegetative or soil fill that may be disposed within the space formed between adjacent fins of other pavers. In addition to spacer 810, paver 800 includes spacers 432 and 434.

Figure 14:
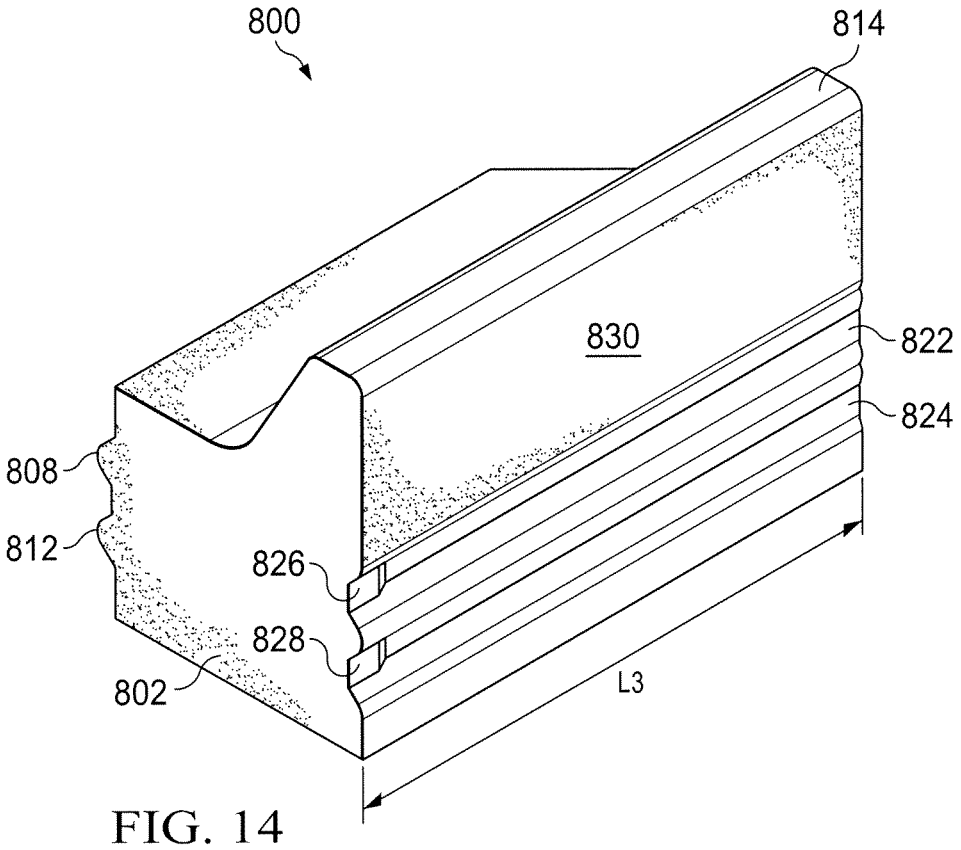
FIG. 14 is a diagram of paver showing grooves disposed in a side and having a length L3, and which include spacers.

FIG. 14 is a diagram of paver 800 showing grooves 822 and 824 disposed in side 830 and having a length L3, and which include spacers 826 and 828. Unlike other pavers disclosed herein, the sum of L1 and L2 does not equal L3 for paver 800, as a result of angled side 816, which is provided to create an additional drainage space and vegetative or soil fill space when paver 800 is installed.

Figure 15:
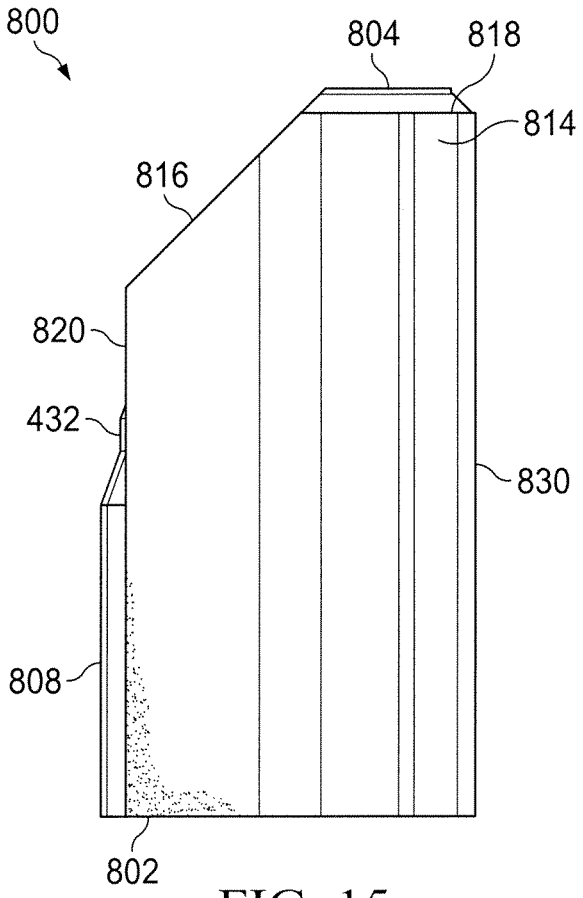
FIG. 15 is an overhead view of a paver showing sides, tongues and a fin.

FIG. 15 is an overhead view of paver 800, showing sides 802, 816, 818, 820 and 830, tongues 804 and 808, spacer 432 and fin 814.

Figure 16:
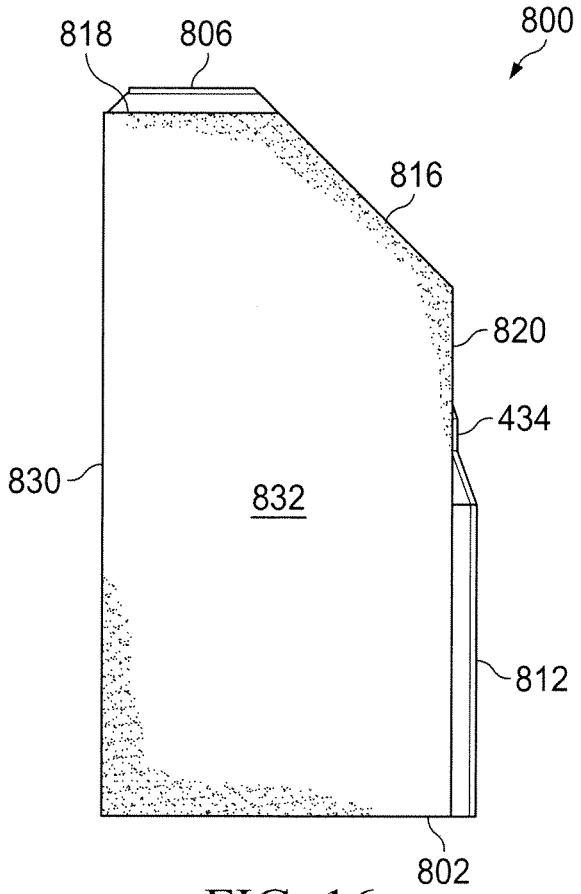
FIG. 16 is a bottom view of a paver showing a base, sides and tongues.

FIG. 16 is a bottom view of paver 800, showing base 832, sides 802, 816, 818, 820 and 830, spacer 434 and tongues 806 and 812. Unlike other disclosed embodiments presented herein, paver 800 has a single side that can form a base, and is installed so that fin 814 is facing upwards.

Figure 17:
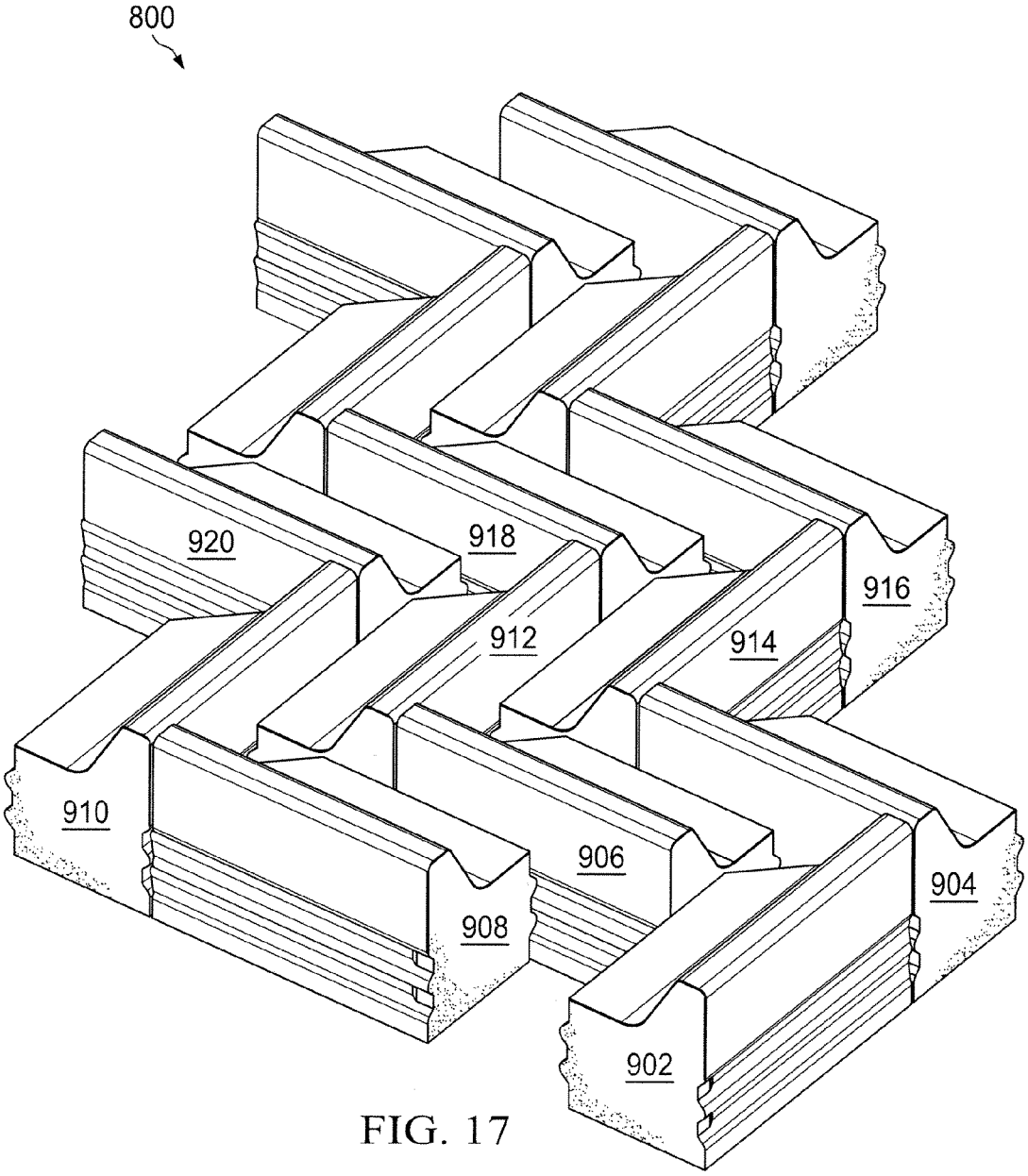
FIG. 17 is a diagram of pavers installed in a herringbone configuration.

FIG. 17 is a diagram of pavers 902 through 920 installed in a herringbone configuration. A first paver 902 is disposed adjacent to a second paver 904, with tongues 804 and 806 of paver 902 inserted into grooves 822 and 824 of paver 904. A third paver 906 is then disposed adjacent to pavers 902 and 904, with side 802 of paver 906 adjacent to the section of side 820 of paver 902 without tongues 808 and 812. Likewise, tongues 808 and 812 of paver 906 are disposed in grooves 822 and 824 of paver 904. Pavers 908 through 920 are disposed in a similar manner, so as to form an upper load-bearing surface of fins 814 of pavers 902 through 920, with spaces between the fins for soil fill and vegetation. Spacers 810, 826 and 828 and angled sides 816 of pavers 902 through 920 provide spaces between the blocks for sand. In this manner, the paving system formed by pavers 902 through 920 allows grass or other vegetation to be provided, to create an aesthetically-pleasing surface, while also providing a load bearing surface with fins 814. Pavers 902 through 920 are also disposed in an interlocking manner, so as to form a herringbone pattern of pavers that provide an interlocking paver system with improved resistance to movement that can be caused by forces applied to each of pavers 902 through 920, such as from an automobile tire, pedestrians, horses or other sources of surface wear and tear.

Figure 18A:
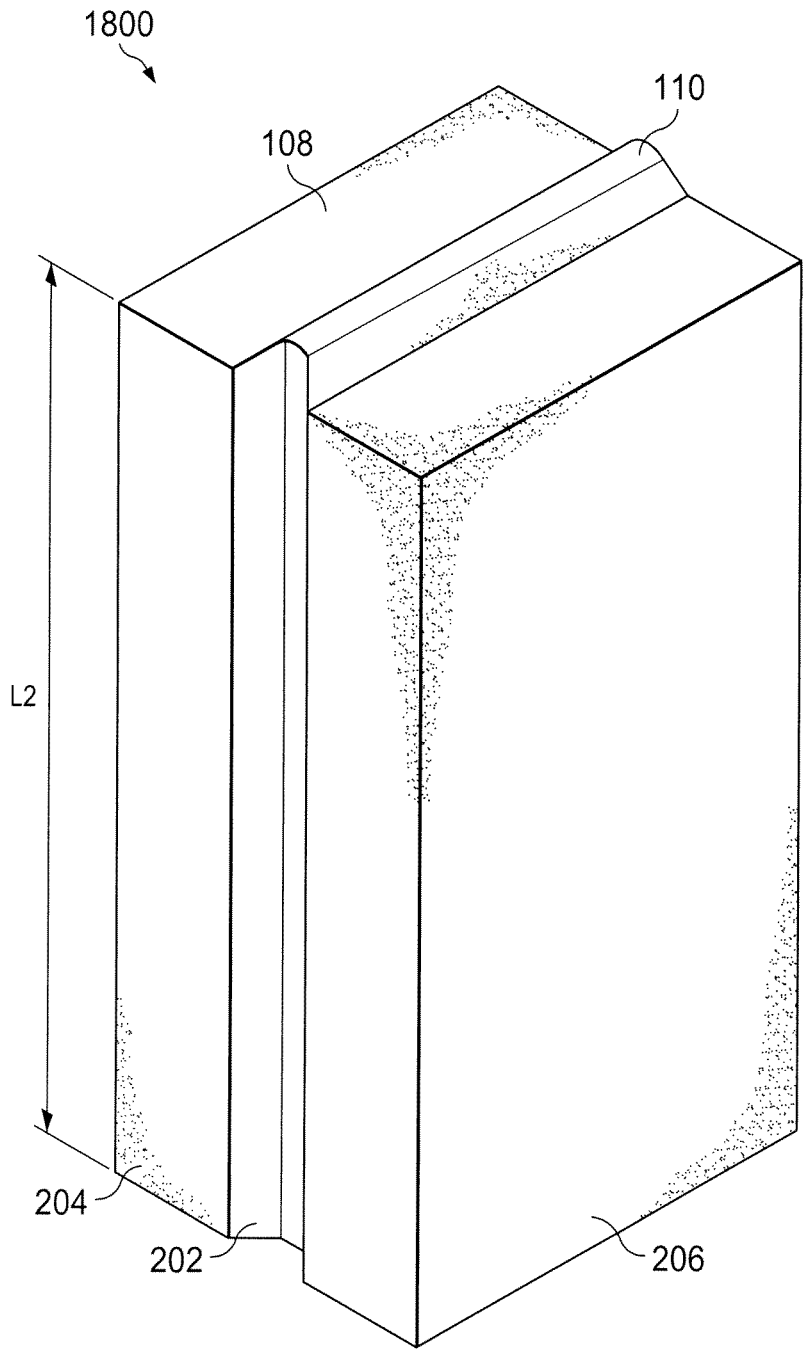
FIGS. 18A and 18B are diagrams of a paver showing sides, tongues and grooves.
Figure 18B:
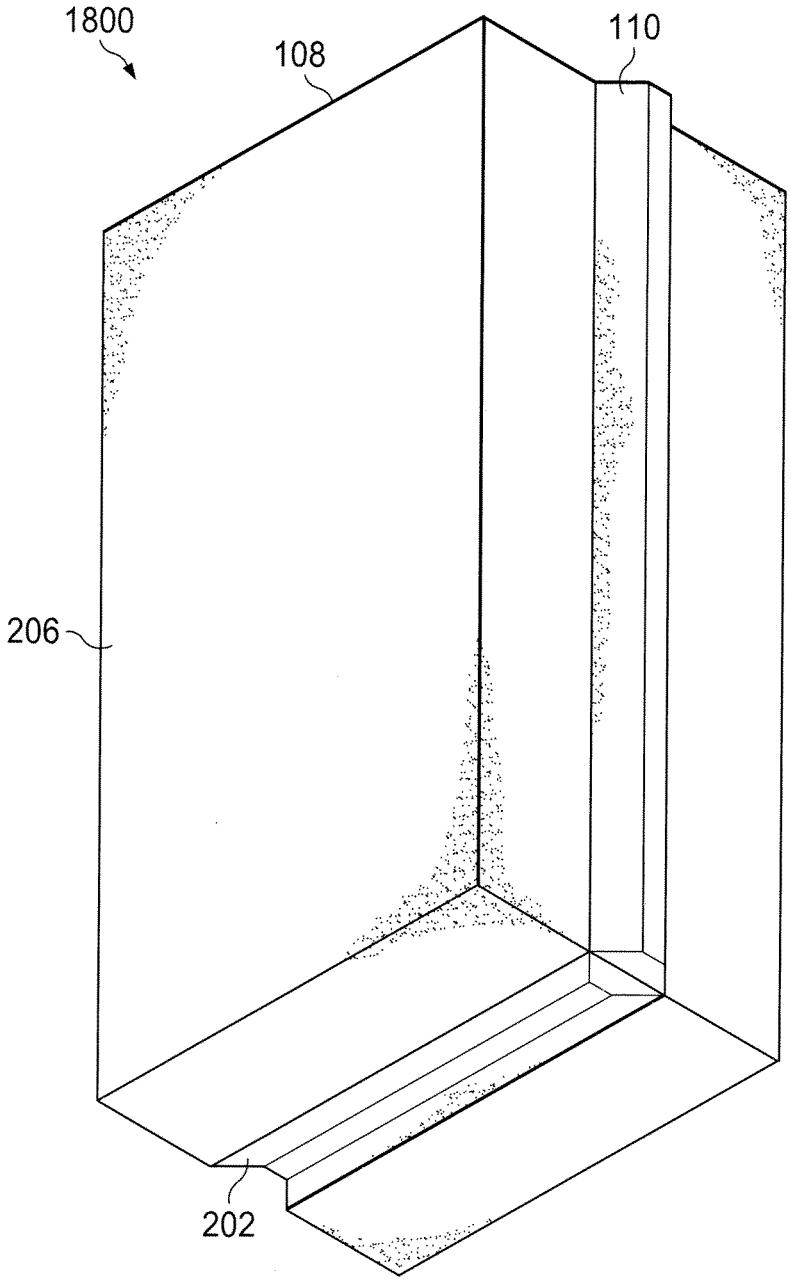

FIGS. 18A and 18B are diagrams of a paver 1800 showing sides, tongues and grooves. Paver 1800 has a tongue on one side and a groove on the opposite side for each set of major and minor sides, so as to allow paver 1800 to be placed in a running bond arrangement.

Figure 19:
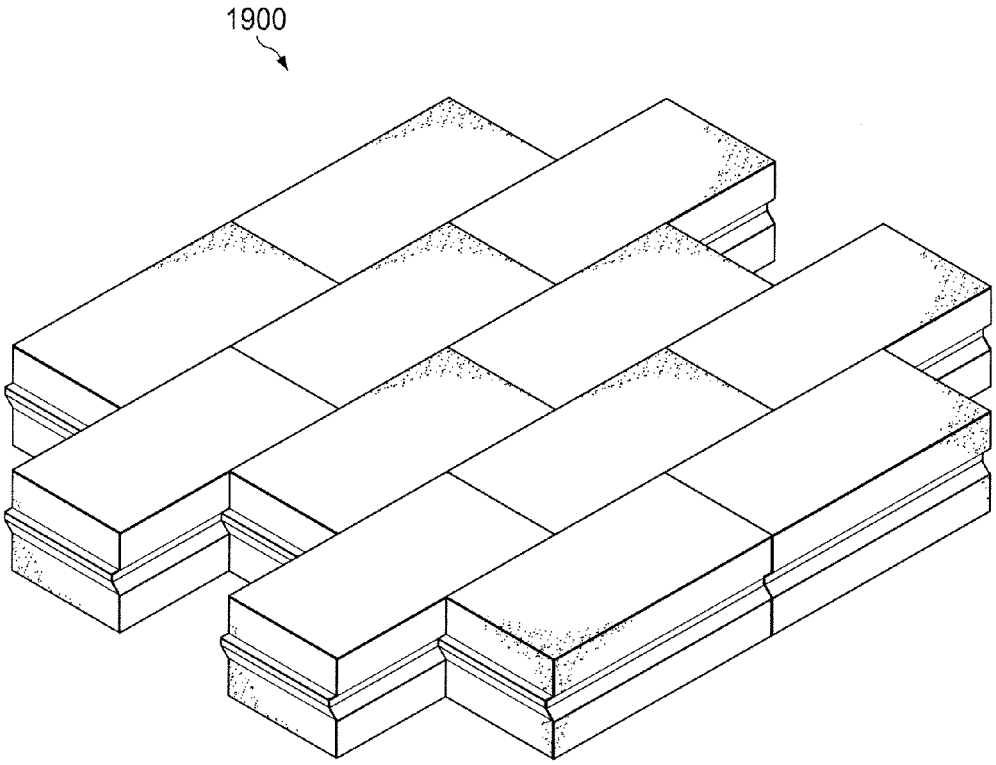
FIG. 19 is a diagram of pavers in a running bond pattern.

FIG. 19 is a diagram of pavers 1900 in a running bond pattern. Pavers 1900 can be arranged to overlap at a suitable location, such that the joint between two series pavers can be located midway between the minor sides of the adjacent pavers, as shown, or in other suitable locations. Likewise, pavers 1900 can be arranged in a common or American, Flemish, English, stack, English cross or Dutch bond pattern or other suitable patterns.

Figure 20:
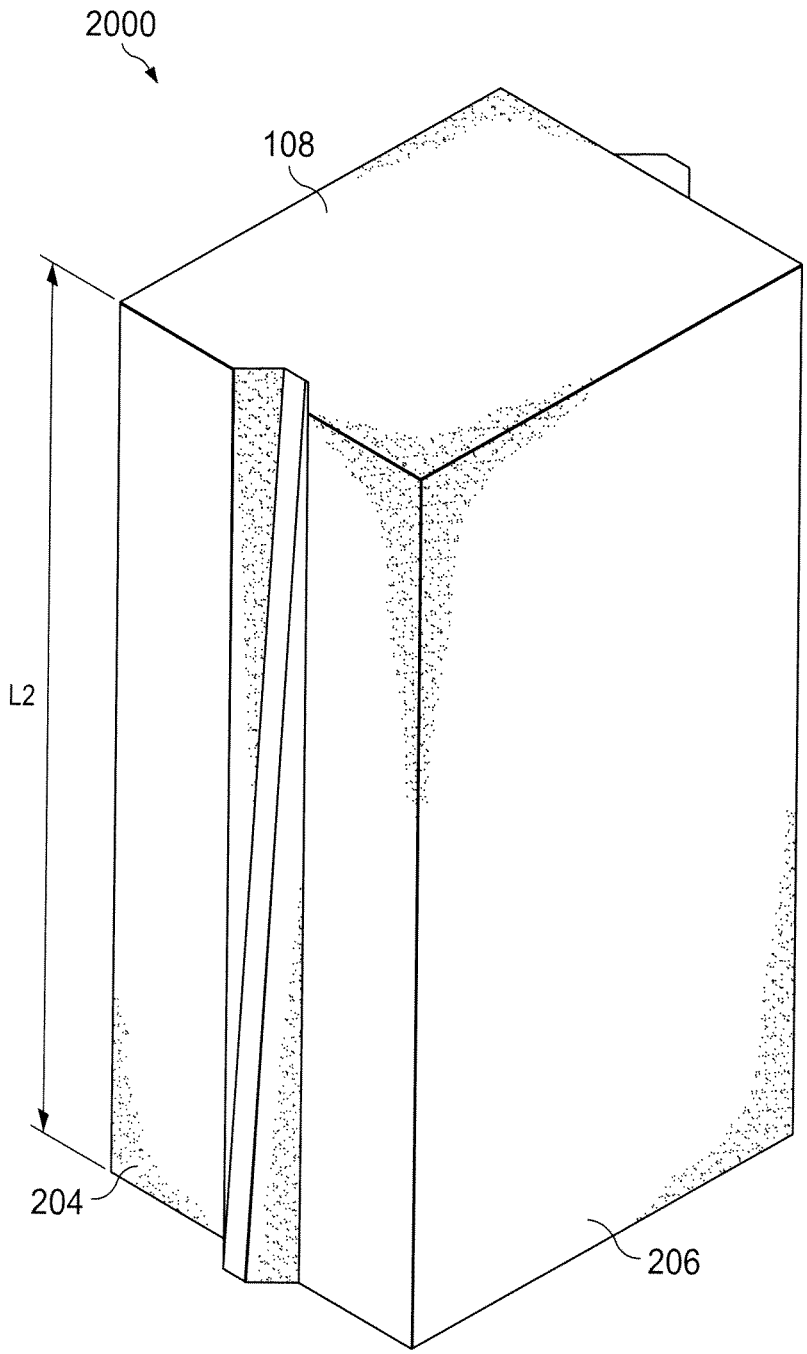
FIG. 20 is a diagram of a paver showing sides and a transition from a tongue to a groove, in accordance with an exemplary embodiment of the present disclosure.

FIG. 20 is a diagram of a paver 2000 showing sides 108, 204 and 206, and a transition from a tongue to a groove on side 204, in accordance with an exemplary embodiment of the present disclosure. Paver 2000 utilizes an interlocking feature that is part tongue and part groove, with a linear transition between the tongue portion and the groove portion, as shown. Likewise, other suitable transitions can be used, such as where one half of the interlocking feature is a tongue and the other half is a groove, where a series of transitions between tongues and grooves are used, or other suitable configurations.

Figure 21:
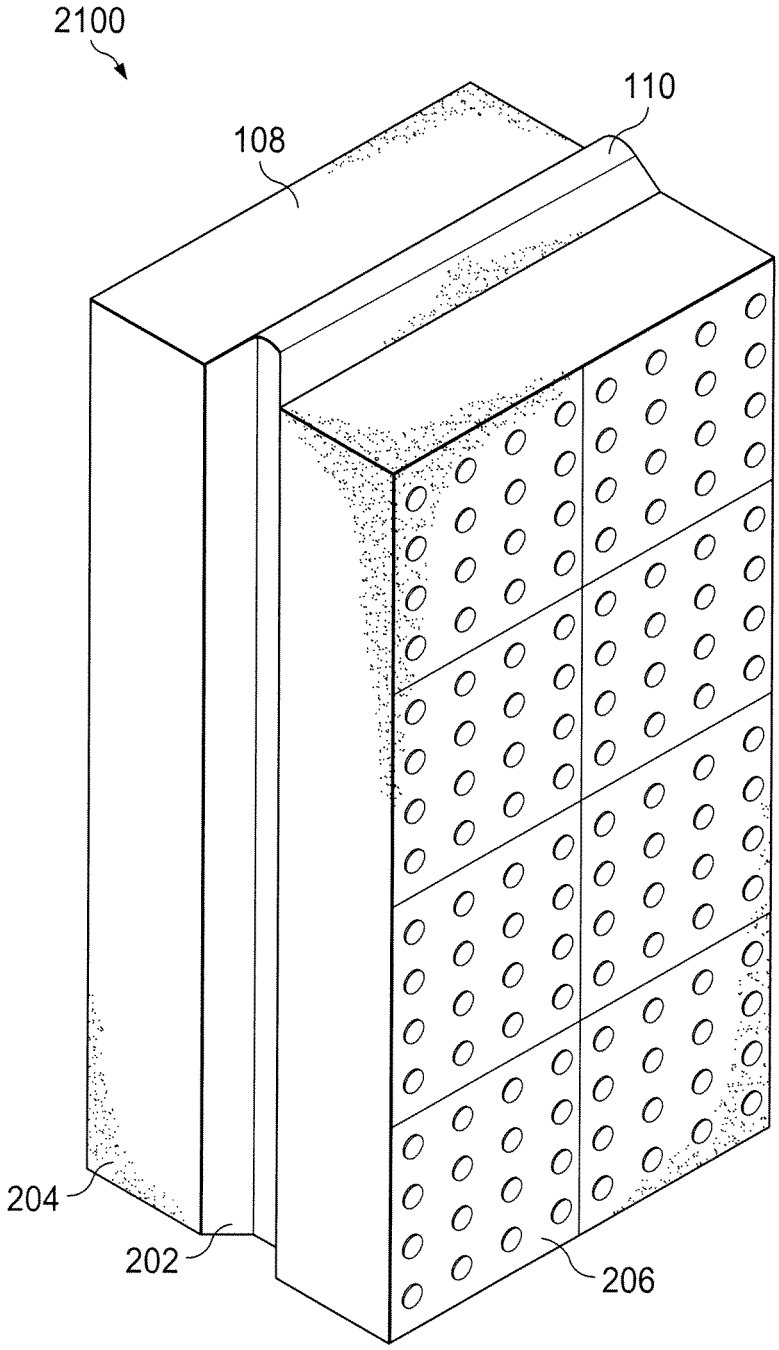
FIG. 21 is a diagram of a paver having a detectable warning in accordance with an exemplary embodiment of the present disclosure.

FIG. 21 is a diagram of a paver 2100 having a detectable warning in accordance with an exemplary embodiment of the present disclosure. Paver 2100 includes a plurality of bumps on side 206 that can be felt by a pedestrian or light vehicle, such as a wheelchair, that alerts the pedestrian or light vehicle occupant to a potential hazard, such as the intersection of a pedestrian walkway with a roadway or other potential hazards. Likewise, paver 2100 can be used to provide improved traction, or side 206 can be oriented downward to provide for improved water distribution. Paver 2100 can also or alternately include ridges or channels in addition to or in place of the bumps as shown. Ribs or other suitable features can also or alternatively be provided that are easier to fabricate than bumps.

The exemplary pavers shown herein can be modified as needed based on the intended application. Using the common brick terminology of cull, beds, side, end and face, these modifications include: 1) a flat cull, a flat end, a groove on one side and a tongue on the opposite face for running bond configurations, with any suitable beds; 2) a groove on the cull, a flat end and a combination of an upper groove and a lower tongue on the side and face for running bond or herringbone configurations, with any suitable beds; 3) a flat cull, a flat end and a combination of an upper groove and a lower tongue on the side and face for running bond configurations, with any suitable beds; 4) a tongue on the cull, groove on the side that extends the entire length of the side, a tongue on the face that extends the entire length of the face and a groove on the end made with a draw plate, for running bond or herringbone configurations, with any suitable beds; 5) a spine on one bed to protect vegetation; 6) spacers on the cull for permeability; 7) ridges or channels on the upward-facing bed for detectable warning or improved traction; 8) ridges or channels on the downward-facing bed for water distribution; 8) the cull can have a tongue, a groove, be flat or have a combination of tongue(s) and groove(s); 9) the end can be flat or have a groove(s); the side and face can have a zero or positive draft;

10) a tongue can extend part or all the way along a surface; 11) a groove can extend part or all the way along a surface; 12) a groove can transition to a flat surface; 13) a groove can transition to a tongue; and 14) a tongue can transition to a flat surface.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A paver comprising:

a first side having a length and a groove disposed along the length of the first side;

a second side having a length and a tongue disposed along the length of the second side;

a third side opposite the first side and having a tongue disposed along the third side, where a length of the tongue of the third side is less than the length of the first side; and a fourth side having a substantially flat surface with a length, where the length of the fourth side is equal to the length of the first side minus the length of the tongue of the third side.

2. The paver of claim 1 further comprising:

a top surface disposed adjacent to the first side, the second side, the third side and the fourth side;

a bottom surface disposed opposite the top surface; and wherein the groove disposed in the first side is located midway between the top surface and the bottom surface.

3. The paver of claim 2 wherein the tongue disposed on the second side is located midway between the top surface and the bottom surface.

4. The paver of claim 1 further comprising a second groove disposed along the length of the first side.

5. The paver of claim 1 further comprising a second tongue disposed along the length of the second side.

6. The paver of claim 1 further comprising a second tongue disposed along the third side.

7. The paver of claim 1 further comprising a spacer disposed within the groove, wherein the spacer extends for a predetermined length of the groove and fills a portion of the groove.

8. The paver of claim 5 further comprising a spacer disposed between the first tongue and the second tongue of the second side, wherein the spacer extends for a predetermined length and fills a portion of a space between the first tongue and the second tongue.

9. A paver comprising:

a cull having a length and a groove disposed along the length of the cull;

a side having a length and a tongue disposed along the length of the side;

an end opposite the cull and having a tongue with a length disposed along the end, where the length of the tongue is less than the length of the cull; and a face having a substantially flat surface with a length.

10. The paver of claim 9 further comprising:

a top bed disposed adjacent to the cull, the side, the end and the face;

a bottom bed disposed opposite the top bed; and wherein the groove disposed in the cull is located midway between the top bed and the bottom bed.

11. The paver of claim 10 wherein the tongue disposed on the side is located midway between the top bed and the bottom bed.

12. The paver of claim 9 further comprising a second groove disposed along the length of the cull.

13. The paver of claim 9 further comprising a second tongue disposed along the length of the side.

14. The paver of claim 9 further comprising a second tongue disposed along the end, the second tongue having the length of the tongue.

15. The paver of claim 9 further comprising a spacer disposed within the groove, wherein the spacer extends for a predetermined length of the groove and fills a portion of the groove.

16. The paver of claim 14 further comprising a spacer disposed between the first tongue and the second tongue, wherein the spacer extends for a predetermined length and fills a portion of a space between the first tongue and the second tongue.

17. A paver comprising:

a first side having a length and a groove disposed along the entire length of the first side;

a second side having a length and a tongue disposed along the entire length of the second side;

a third side opposite the first side and having a tongue disposed along the third side for an entire length of the third side, where the length of the third side is less than the length of the second side; and a fourth side having a substantially flat surface with a length, where the length of the fourth side is equal to the length of the first side minus the length of the third side.

18. The paver of claim 17 further comprising:

a top surface disposed adjacent to the first side, the second side, the third side and the fourth side;

a bottom surface disposed opposite the top surface; and wherein the groove disposed in the first side is located midway between the top surface and the bottom surface.

19. The paver of claim 18 wherein the tongue disposed on the second side is located midway between the top surface and the bottom surface.

20. The paver of claim 17 further comprising a second groove disposed along the length of the first side and parallel to the other groove of the first side.

* * * * *